United States Patent [19]

Kato

[11] Patent Number: 5,077,005

[45] Date of Patent: Dec. 31, 1991

[54] HIGH-CONDUCTIVITY COPPER ALLOYS WITH EXCELLENT WORKABILITY AND HEAT RESISTANCE

[75] Inventor: Masanori Kato, Tokyo, Japan

[73] Assignee: Nippon Mining Co., Ltd., Tokyo, Japan

[21] Appl. No.: 486,029

[22] Filed: Feb. 27, 1990

[30] Foreign Application Priority Data

Mar. 6, 1989 [JP] Japan ..... 1-53176

[51] Int. Cl.[5] ..... C22C 9/00

[52] U.S. Cl. ..... 420/469; 420/470; 420/474; 420/489; 420/491; 420/492; 420/497; 420/498; 420/499; 420/500

[58] Field of Search ..... 420/469, 470, 474, 489, 420/491, 492, 497, 498, 499, 500

[56] References Cited

U.S. PATENT DOCUMENTS 4,676,827 6/1987 Hosoda et al. ..... 420/469
4,717,436 1/1988 Hosoda et al. ..... 420/500

FOREIGN PATENT DOCUMENTS 0296596 12/1988 European Pat. Off. .
56-139643 10/1981 Japan ..... 420/491
61-259558 11/1986 Japan .
62-253745 11/1987 Japan .
63-65034 3/1988 Japan .
63-65036 3/1988 Japan .
63-238232 10/1988 Japan .
63-238234 10/1988 Japan .
63-238235 10/1988 Japan .
1-011931 1/1989 Japan .
1-234537 9/1989 Japan .
1-246334 10/1989 Japan .

*Primary Examiner*—R. Dean
*Assistant Examiner*—David W. Schumaker
*Attorney, Agent, or Firm*—Seidel, Gonda, Lavorgna & Monaco

[57] ABSTRACT

There is provided a high-conductivity copper alloy with excellent workability and heat resistance, characterized by the alloy consists essentially of, by weight, at least one element selected from the group consisting of

| | |
|---|---|
| 10–100 ppm In (indium), | 10–1000 ppm Ag (silver), |
| 10–300 ppm Cd (cadmium), | 10–50 ppm Sn (tin), |
| 10–50 ppm Sb (antimony), | 3–30 ppm Pb (lead), |
| 3–30 ppm Bi (bismuth), | 3–30 ppm Zr (zirconium), |
| 3–50 ppm Ti (titanium) and | 3–30 ppm Hf (hafnium), |

and the balance copper. S (sulfur) and O (oxygen) as unavoidable impurities are controlled to amounts of less than 3 ppm S, and less than 5 ppm O, respectively. Other unavoidable impurities are controlled to less than 3 ppm in total amount. The alloy is very suitable for applications such as forming magnet wires and other very thin wires, lead wires for electronic components, lead members for tape automated bonding (TAB) and the like, and members for printed-circuit boards.

7 Claims, 5 Drawing Sheets

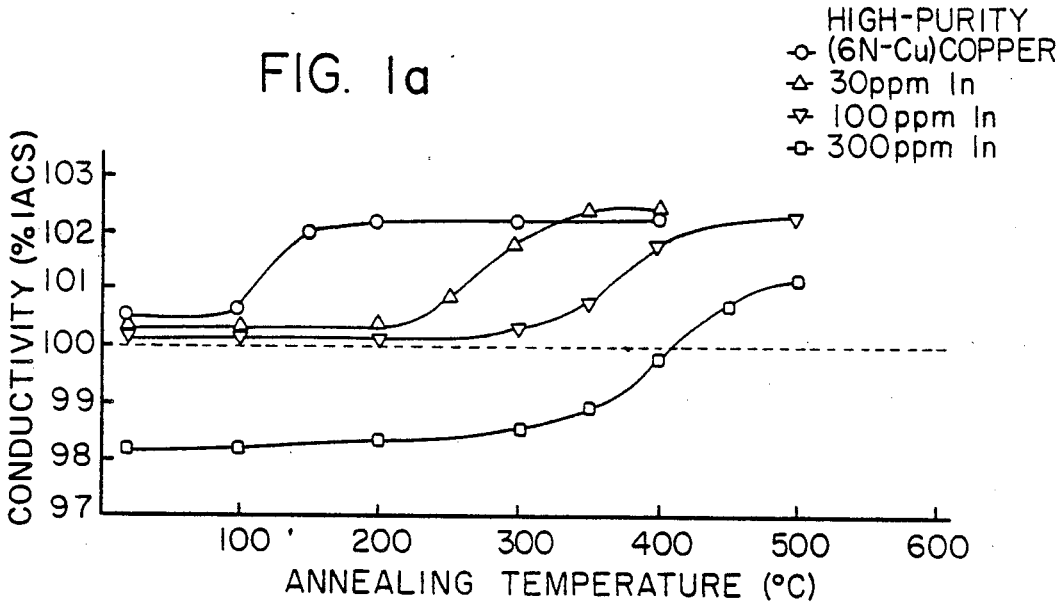
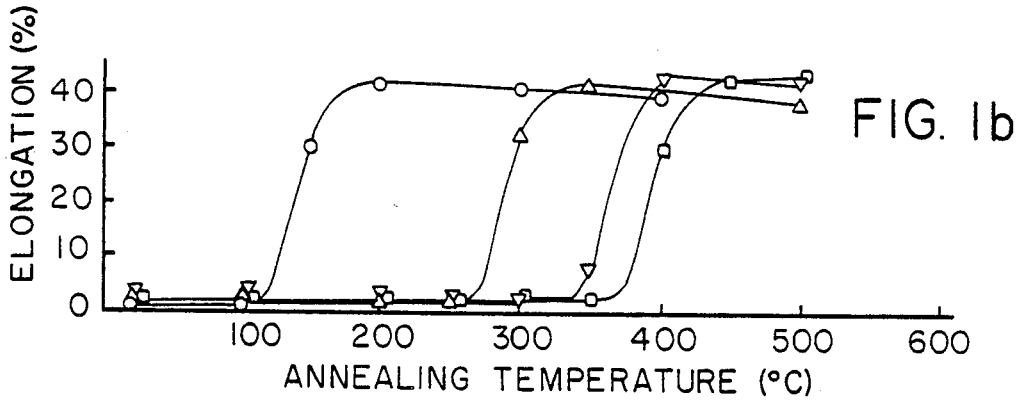
FIG. 1b
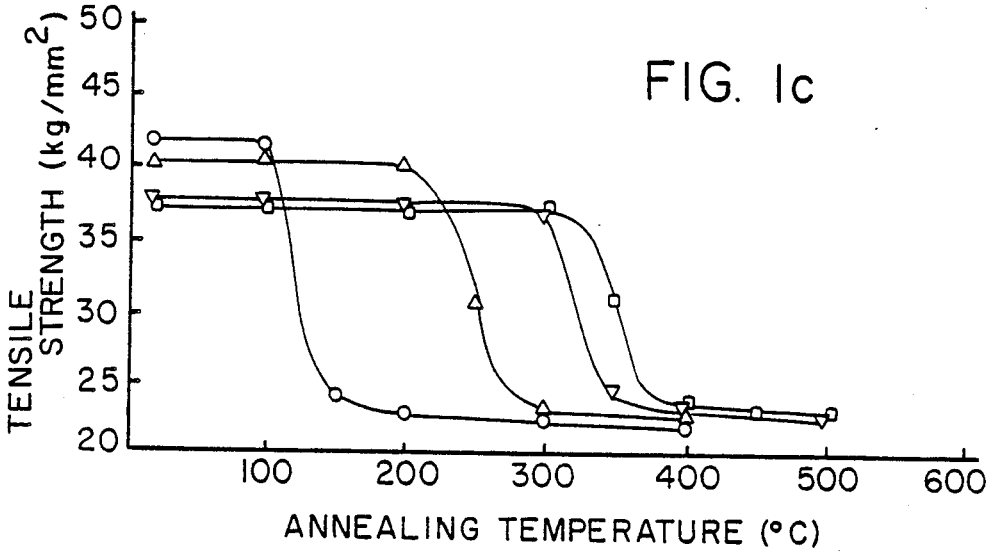

HIGH-PURITY
(6N-Cu) COPPER
20ppm Zr
50ppm Zr

HIGH-CONDUCTIVITY COPPER ALLOYS WITH EXCELLENT WORKABILITY AND HEAT RESISTANCE

FIELD OF THE INVENTION

This invention relates to high-conductivity copper alloys with excellent workability and heat resistance suited for applications such as magnet wires and other very thin wires, lead wires for electronic components, lead members for tape automated bonding (TAB) and the like, and members for printed-circuit boards.

BACKGROUND OF THE INVENTION

Copper is a metal excellent in electric conductivity but inferior in mechanical strength. For the reason, in practical uses, it is a customary countermeasure to reinforce copper by the addition of some additive (an alloying element or elements). However, in the fields where conductivity is of prime importance (e.g., in the manufacture of very thin wires such as magnet wires, lead wires for electronic components, lead members such as TAB or others, and members for printed-circuit boards), pure copper (with purity on the order of 99.99%) is usually used to keep the outstanding conductivity of copper unimpaired.

A problem is that the higher the purity the softer copper becomes, with the increasing risk of breaking due to "stretching-to-break" during wire drawing or other similar working operation. In particular, it has been pointed out in the art that coating with urethane, polyimide, or the like, lessens seriously the mechanical strength of pure copper wires or members or parts, rendering it difficult for those to maintain their shapes, which causes "bending or turning", "over-elongation", "droop", or other troubles. Nevertheless, "high electric conductivity" has remained the most required of the properties of conductive materials for electric wires and other similar applications. Since conductivity is preferred to mechanical strength (which is intimately related to wire drawability and other working characteristics of the material), heat resistance, and other properties, pure copper has predominantly been obliged to be used.

Meanwhile, there have been intensified demands over the years for the miniaturization of electronic components, for thinner electric wires, and for efficient operation of the manufacturing processes. To keep up with the trend, requirements for copper materials are becoming more and more exacting. Materials not merely possessing excellent conductivity but, in addition, combining conductivity with greater mechanical strength, heat resistance, and other properties are in stronger demand than heretofore.

In view of these, the present applicant, in its attempts at meeting the above requirements, previously made some proposals as to "copper materials based on high-purity copper with the addition of minute amounts of In, Hf, Mg, Be, B, Zr, Y, Ag, Si, Ca, or/and a rare earth element or elements" (Patent Application Public Disclosure Nos. 127436/ 1987 and 127438/1987, and Patent Application No. 73152/1988).

The above copper materials proposed by the applicant exhibited better mechanical strength and heat resistance than conventional products while retaining the conductivity of the level of pure copper. Those favorable properties promised a high contribution of the materials to the qualitative improvement in electric and electronic components.

However, the prospects of ever escalating performance requirements are suggesting that there are still limits to such materials in the points of mechanical strength, heat resistance, and other properties.

OBJECT OF THE INVENTION

With the foregoing in view, the present invention has for its object to provide copper materials much improved in mechanical strength and heat resistance over the conventional products while retaining as high a level of conductivity as pure copper.

SUMMARY OF THE INVENTION

The present inventor has made intensive studies with numerous experiments to realize the above object. These efforts have led to the following unexpected discoveries:

(a) Among the elements in Group b of the Periodic Table, In, Ag, Cd, Sn, Sb, Pb, and Bi, and also the active elements Zr, Ti, and Hf of Group a of the Periodic Table can serve as very desirable alloying elements. Specifically, when they added only in very small amounts, they markedly improve the mechanical strength, heat resistance, etc. of copper with substantially no adverse effects upon the conductivity.

(b) The copper materials previously proposed by the applicant likewise is based on a copper with a purity of 5N (99.999%) to 6N (99.9999%) Cu and including partly similar elements. In spite of this fact, the reason why their improvements of mechanical strength and heat resistance were still insufficient has now become clear as follows: The evaluation with respect to purity of a rating "5N Cu" or "6N Cu" was done with the exclusion of C, O, N and H according to a customary manner. The final purity of such copper material containing these elements in its end use is actually dependent on its history (for example, melting, heat treatments in varied atmospheres, etc.). That is, these impurity elements, especially O, behave to hinder the desirable actions of the alloying elements (e.g., imparting improved mechanical strength and heat resistance). The presence of such impurity elements thus places limits on the effects of improving the mechanical strength and heat resistance which otherwise could have attained by "minor amount of addition of an alloying element enough to avoid an adverse influence upon the conductivity." For this reason, it is essential to more strictly control the contents of these impurities than in conventional definition. Other impurity elements which also behave unfavorably, besides O, are such gaseous constituents as C, N, and H, as noted above. It has now also been found that the presence of S is also of particular concern.

(c) It is therefore essential to restrict the contents of S and O, among all unavoidable impurities, within specific ranges, while also controlling the total content of the impurities. Under these conditions, when a copper alloy is prepared by allowing copper to contain one or two or more alloying elements chosen from among the group of In, Ag, Cd, Sn, Sb, Pb, Bi, Zr, Ti and Hf, in an amount or amounts minute enough to have practically no adverse effect upon the conductivity, a material can be obtained which combines outstanding conductivity well comparable to that of pure copper with markedly improved mechanical strength (which dictates the workability), heat resistance, and other properties. The present invention, predicated upon the foregoing discoveries, provides a high-conductivity copper alloy with excellent workability and heat resistance, characterized by that said copper alloy is consisted essentially of, by weight, at least one element selected from the group consisting of

| | |
|---|---|
| 10–100 ppm In (indium), | 10–1000 ppm Ag (silver), |
| 10–300 ppm Cd (cadmium), | 10–50 ppm Sn (tin), |
| 10–50 ppm Sb (antimony), | 3–30 ppm Pb (lead), |
| 3–30 ppm Bi (bismuth), | 3–30 ppm Zr (zirconium), |
| 3–50 ppm Ti (titanium) and | 3–30 ppm Hf (hafnium), |

and the balance copper, and that S (sulfur) and O (oxygen) as unavoidable impurities are controlled to amounts of less than 3 ppm S and less than 5 ppm O, respectively, and other unavoidable impurities are controlled to less than 3 ppm in total amount.

DESCRIPTION OF THE DRAWINGS

FIG. 1 shows annealing curves of In-containing high-purity copper alloys;

DETAILED DESCRIPTION

Figure 2A:
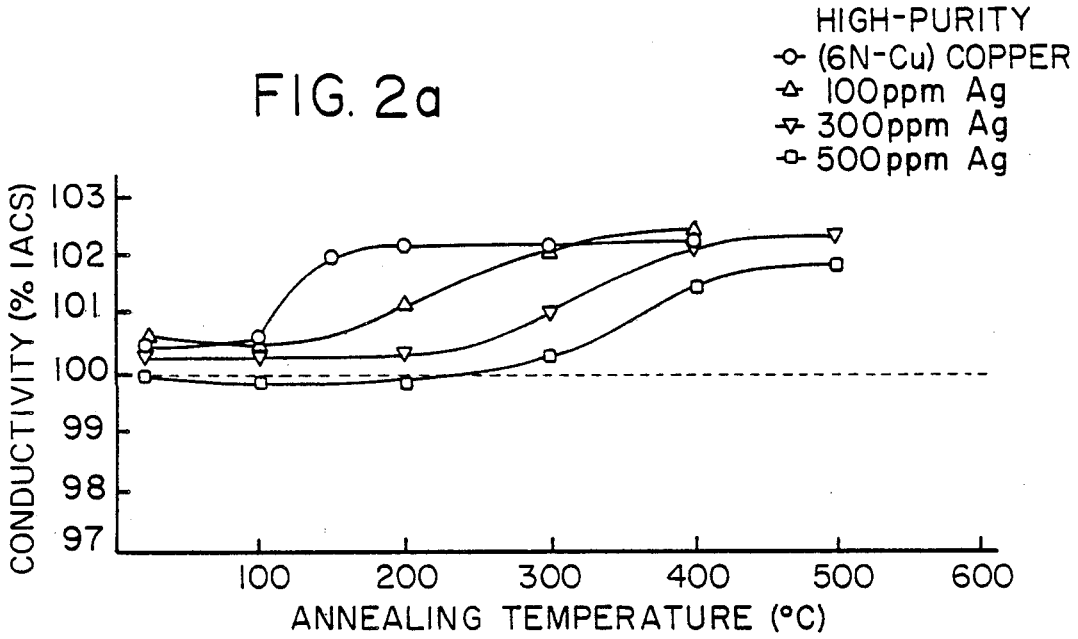
FIG. 2 shows annealing curves of Ag-containing high-purity copper alloys.

The grounds on which the composition of the high-conductivity copper alloys of the invention is defined as above and the functions and effects of the individual constituents will be explained in detail.

The alloying elements In, Ag, Cd, Sn, Sb, Pb, Bi, Zr, Ti and Hf all act to form a solid solution with Cu to improve the mechanical strength of the resulting copper alloy and elevate its recrystallization temperature. Copper, therefore, is allowed to contain one such element, or two or more where necessary. Improvement in mechanical strength is effective in preventing breaking during wire drawing, resulting in better workability of the material and greater shape retention of the formed products. Elevated recrystallization temperature, of course, means enhanced heat resistance.

If the content of any such alloying element used is below the lower limit of the specified range, the desirable effect is not attained. Conversely if the content exceeds the upper limit, the effect upon the conductivity is so serious that the conductivity on the pure copper level is no longer secured. It is for these reasons that the content of In, Ag, Cd, Sn, Sb, Pb, Bi, Zr, Ti, and Hf is fixed within the range of: In 10–100 ppm; Ag 10–1000 ppm; Cd 10–300 ppm; Sn 10–50 ppm; Sb 10–50 ppm; Pb 3–30 ppm; Bi 3–30 ppm; Zr 3–30 ppm; Ti 3–50 ppm; and Hf 3–30 ppm.

Preferable ranges of these additives are as follows:

| | |
|---|---|
| 30–80 ppm In, | 100–800 ppm Ag, |
| 30–150 ppm Cd, | 20–40 ppm Sn, |
| 20–40 ppm Sb, | 10–25 ppm Pb, |
| 10–25 ppm Bi, | 5–20 ppm Zr, |
| 5–30 ppm Ti and | 5–20 ppm Hf. |

Sulfur as an unavoidable impurity is an element which easily combines with other ingredients to form compounds, which in turn deteriorate the heat resistance, mechanical strength, workability (drawability) and the like of the resulting alloy. The S content must, therefore, be as low as possible. Importantly, for the copper alloys of the invention, an S content in excess of 3 ppm would strikingly reduce the property-improving actions of the alloying elements, rendering it impossible to improve the properties while securing the conductivity of pure copper. Hence the S content is specified to be less than 3 ppm, preferably less than 2 ppm, and more preferably less than 1.5 ppm.

Oxygen is another unavoidable impurity, the ingress of which into the alloy is inevitable. The O content too must be minimized because it readily forms compounds (oxides) with other constituents, thus reducing the heat resistance, mechanical strength, workability (drawability) etc. of the alloy. Oxygen easily finds an entrance from the surrounding atmosphere into metallic copper after the production of the alloy base, e.g., during the melting or hot processing such as heat treatment. It then combines with the alloying elements added to copper for property improvements, to form oxides in Cu, thereby reducing the amount of the alloying elements available for forming solid solutions. Consequently, it becomes difficult to ensure desired heat resistance, mechanical strength, etc. with amounts of alloying elements that are only just enough to maintain the conductivity on the pure copper level. Thus, while the O content is desired to be a minimum, its unfavorable effects as noted above may be reduced to generally allowable limits if the content is below 5 ppm. Hence the specified O content is less than 5 ppm, preferably less than 3–4 ppm. For the sake of balance between the manufacturing cost and performance of the alloy, an O content on the order of 1 to 2 ppm is more realistic.

Typical of the unavoidable impurities besides S and O include C, N, and H. The contents of these impure elements must also be minimized because of their undesirable influences upon the alloy properties required under the invention. The total content of these unavoidable impurities is specified to be less than 3 ppm, since it is the limit below which the impurities have adverse effects within permissible ranges.

The major advantageous effects offered by the copper alloys of the specified composition are as follows:

i) The high conductivity makes the alloys well suited for use as wire materials (for audiovisual and electronic wirings), and the conductivity plus excellent strength and heat resistance open up new markets for the alloys in the field of special electric wires.

ii) Because the amounts of the alloying elements added are small and the amounts of impure elements are limited to very minor amounts, the resulting alloys are free from large nonmetallic inclusions or voids. They therefore have sufficient bending fatigue resistance to withstand severe cold working (e.g., deep drawing and ultrafine-gage wire drawing). They also provide materials suited as materials for working into superfine wires or ultrathin foils.

iii) Little intergranular concentration of impurities makes the alloys practically non-brittle. This promises marketability for the alloys as materials to be hard cold worked (e.g., in heading or deep drawing).

iv) The resulting alloys are work-hardened only to a slight degree during cold working and still exhibit good heat resistance. They therefore undergo practically negligible changes in mechanical properties during working and while in use.

In manufacturing the alloys according to the present invention, it is desirable from the viewpoint of product quality and productivity to choose a continuous casting process whereby a high-purity copper rod or billet or the like satisfying can be produced efficiently and safely, (a) high purity as a production alloy, (b) extremely small amounts of internal faults such as foreign matter and pinholes, (c) uniformity in quality throughout continuous length, with only limited segregation, and (d) obtainment of unidirectionally solidified structure, or, where necessary, single crystalline structure.

Processes which can meet the above requirements are, for example, the two the applicant previously proposed, i.e.:

(A) A process for continuously casting a billet or the like through a mold with one end protruded into a molten copper bath and the other end being cooled; and (B) A continuous casting process in which molten copper stored in a first vessel is drawn by suction into a second vessel, where it is vacuum refined; and a billet or the like is withdrawn through a mold with one end protruded into the molten copper bath in the first vessel and the other end cooled.

The process (B) is a particularly suitable means for the addition of active elements to copper and for the manufacture of a high-purity material.

The advantages of the invention will be further explained in the following examples.

EXAMPLES

Electrolytic copper of 6N(99.9999% Cu) purity was vacuum melted by high-frequency heating in a graphite crucible, an alloying element or elements were added, and each charge was continuously cast in an Ar atmosphere. In this way, 11 mm-dia. rods of the chemical compositions shown in Table 1 were obtained.

The rods then were cold drawn to 2 mm-dia. wires. The tensile strength and electric conductivity of the materials as drawn were measured.

Next, the 2 mm-dia. wires were held at varied temperatures for one hour to determine their semisoftening temperature limits and also the electric conductivity of the annealed materials.

The results are also given in Table 1.

As will be clear from Table 1, all the copper alloys that satisfy the conditions specified under the invention exhibited excellent strength (hence workability), heat resistance, and electric conductivity. It can be confirmed, on the other hand, that the materials of chemical compositions that fall to satisfy the conditions were inferior in at least one of strength (workability), heat resistance, or conductivity.

TABLE 1

| Type of Material | | Chemical Composition (ppm) In | Ag | Cd | Sn | Sb | Pb | Bi | Zr | Hf | Ti | S | O | Total amount of other impurities | Cu | Tensile Strength (kg/mm$^2$) | Semi-softening Temperature (°C.) | Electric Conductivity (% IACS) After wire drawing | After annealing |
|---|---|---|---|---|---|---|---|---|---|---|---|---|---|---|---|---|---|---|---|
| Alloys of the Invention | 1 | 30 | — | — | — | — | — | — | — | — | — | 0.1 | tr. | <3 | bal. | 40.1 | 250 | 100.4 | 102.4 |
| | 2 | 60 | — | — | — | — | — | — | — | — | — | 0.5 | 2 | <3 | " | 39.6 | 280 | 100.3 | 102.4 |
| | 3 | 100 | — | — | — | — | — | — | — | — | — | 0.3 | 3 | <3 | " | 38.2 | 320 | 100.2 | 102.3 |
| | 4 | — | 500 | — | — | — | — | — | — | — | — | 1.1 | 3 | <3 | " | 37.1 | 320 | 99.9 | 101.8 |
| | 5 | — | — | 100 | — | — | — | — | — | — | — | 1.5 | 3 | <3 | " | 42.8 | 300 | 99.6 | 101.6 |
| | 6 | — | — | — | 30 | — | — | — | — | — | — | 0.5 | 2 | <3 | " | 40.8 | 240 | 99.9 | 102.0 |
| | 7 | — | — | — | — | 30 | — | — | — | — | — | 0.8 | 2 | <3 | " | 41.2 | 230 | 99.8 | 101.9 |
| | 8 | — | — | — | — | — | 20 | — | — | — | — | 0.5 | 2 | <3 | " | 42.4 | 210 | 99.3 | 101.3 |
| | 9 | — | — | — | — | — | — | 20 | — | — | — | 0.6 | 2 | <3 | " | 42.2 | 220 | 99.2 | 101.3 |
| | 10 | — | — | — | — | — | — | — | 20 | — | — | 0.2 | tr. | <3 | " | 41.5 | 350 | 100.0 | 102.1 |
| | 11 | — | — | — | — | — | — | — | — | 20 | — | 0.4 | tr. | <3 | " | 40.3 | 330 | 100.1 | 102.2 |
| | 12 | — | — | — | — | — | — | — | — | — | 30 | 0.2 | 2 | <3 | " | 40.9 | 330 | 99.5 | 101.6 |
| | 13 | 20 | — | — | — | — | — | — | 10 | — | — | 0.5 | 3 | <3 | " | 40.4 | 320 | 100.1 | 102.2 |
| | 14 | 60 | — | — | — | — | — | — | — | 10 | — | 0.4 | 2 | <3 | " | 42.3 | 340 | 100.3 | 102.3 |
| | 15 | 60 | — | — | — | — | — | — | — | — | 20 | 0.2 | 2 | <3 | " | 42.5 | 330 | 100.0 | 102.0 |
| | 16 | — | 100 | — | — | — | — | — | — | — | 20 | 0.8 | 4 | <3 | " | 41.3 | 290 | 100.0 | 102.1 |
| | 17 | — | — | — | 20 | — | — | — | 10 | — | — | 0.3 | 2 | <3 | " | 40.5 | 320 | 99.9 | 102.0 |
| | 18 | — | 200 | — | — | — | — | — | 10 | — | — | 0.5 | 3 | <3 | " | 40.8 | 330 | 99.7 | 101.7 |
| | 19 | — | — | 50 | — | — | — | — | — | 10 | — | 0.6 | 2 | <3 | " | 42.2 | 310 | 99.4 | 101.5 |
| | 20 | — | — | — | — | 20 | — | — | — | — | 20 | 0.4 | 2 | <3 | " | 41.7 | 300 | 99.6 | 101.7 |
| | 21 | — | — | — | — | — | 10 | — | 10 | — | — | 0.8 | 3 | <3 | " | 40.1 | 290 | 100.3 | 102.4 |
| | 22 | — | — | — | — | — | — | 10 | — | 10 | — | 0.5 | 2 | <3 | " | 40.4 | 300 | 99.7 | 101.8 |
| Comparative Alloys | 23 | 5 | — | — | — | — | — | — | — | — | — | 0.2 | 2 | bal. | | 40.7 | 120 | 100.5 | 102.5 |
| | 24 | 300 | — | — | — | — | — | — | — | — | — | 1.3 | 3 | " | | 37.3 | 350 | 98.2 | 101.1 |
| | 25 | 100 | — | — | — | — | — | — | — | — | — | 6.0 | 12 | " | | 40.3 | 190 | 98.9 | 101.5 |
| | 26 | — | — | 400 | — | — | — | — | — | — | — | 0.6 | 3 | " | | 37.6 | 320 | 96.8 | 99.3 |
| | 27 | — | — | — | 30 | — | — | — | — | — | — | 0.5 | 10 | " | | 43.2 | 180 | 99.7 | 101.9 |
| | 28 | — | — | — | — | 100 | — | — | — | — | — | 0.7 | 2 | " | | 38.4 | 300 | 97.9 | 100.5 |
| | 29 | — | 5 | — | — | — | — | — | — | — | — | 0.8 | 2 | " | | 40.8 | 120 | 100.1 | 102.4 |
| | 30 | — | — | — | — | — | 40 | — | — | — | — | 0.7 | 3 | " | | 43.5 | 240 | 98.6 | 101.2 |

TABLE 1-continued

| Type of Material | Chemical Composition (ppm) In | Ag | Cd | Sn | Sb | Pb | Bi | Zr | Hf | Ti | S | O | Total amount of other impurities | Cu | Tensile Strength (kg/mm²) | Semi-softening Temperature (°C.) | Electric Conductivity (% IACS) After wire drawing | After annealing |
|---|---|---|---|---|---|---|---|---|---|---|---|---|---|---|---|---|---|---|
| 31 | — | — | — | — | — | — | — | 50 | — | — | 1.0 | 3 | " | | 40.6 | 450 | 98.3 | 100.8 |
| 32 | — | — | — | — | — | — | — | — | 50 | — | 0.6 | 3 | " | | 40.2 | 430 | 98.6 | 101.1 |
| 33 | — | — | — | — | — | — | — | — | — | 100 | 1.1 | 3 | " | | 37.7 | 380 | 96.2 | 98.7 |
| 34 | — | — | — | — | — | — | — | — | — | — | 0.1 | 2 | <3 | bal. | 41.8 | 120 | 100.5 | 102.6 |
| 35 | — | 12 | — | — | — | — | — | — | — | — | 8.3 | 5 | bal. | | 45.2 | 150 | 97.8 | 100.8 |

34: 6N—Cu material.
35: General-purpose OFC material of 3N purity.

Figure 2B:
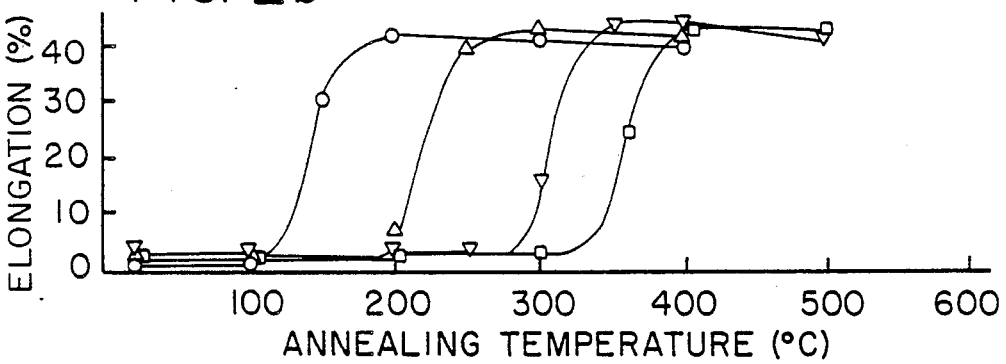
Figure 2C:
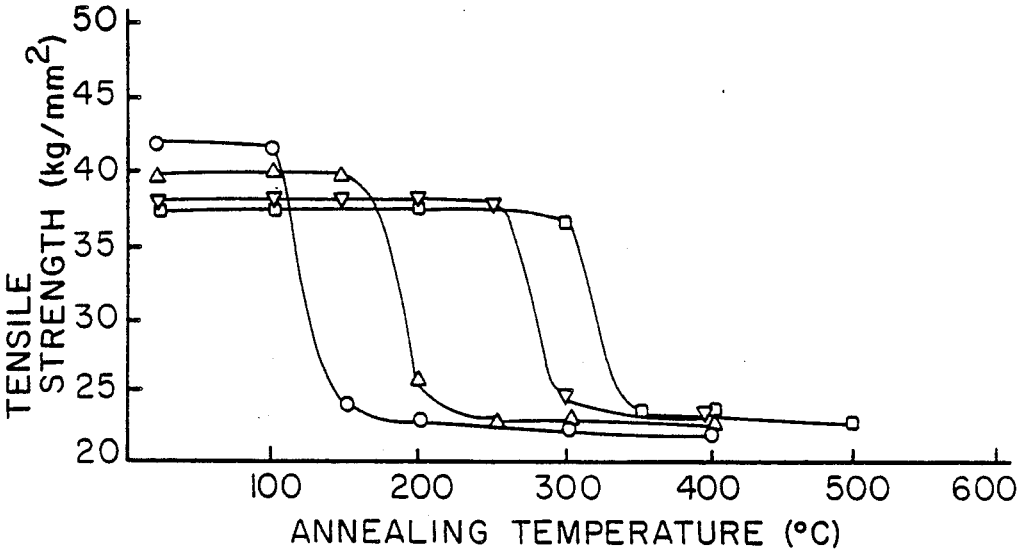
Figure 3A:
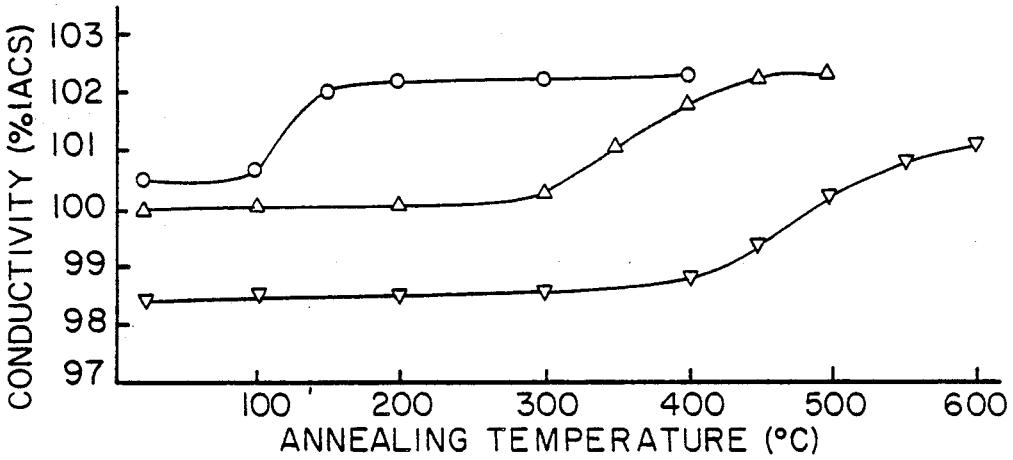
FIG. 3 shows annealing curves of Zr-containing high-purity copper alloys.
Figure 3B:
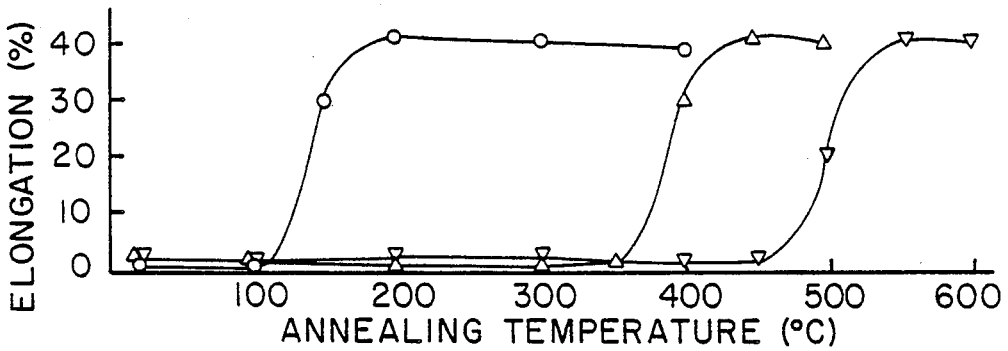
Figure 3C:
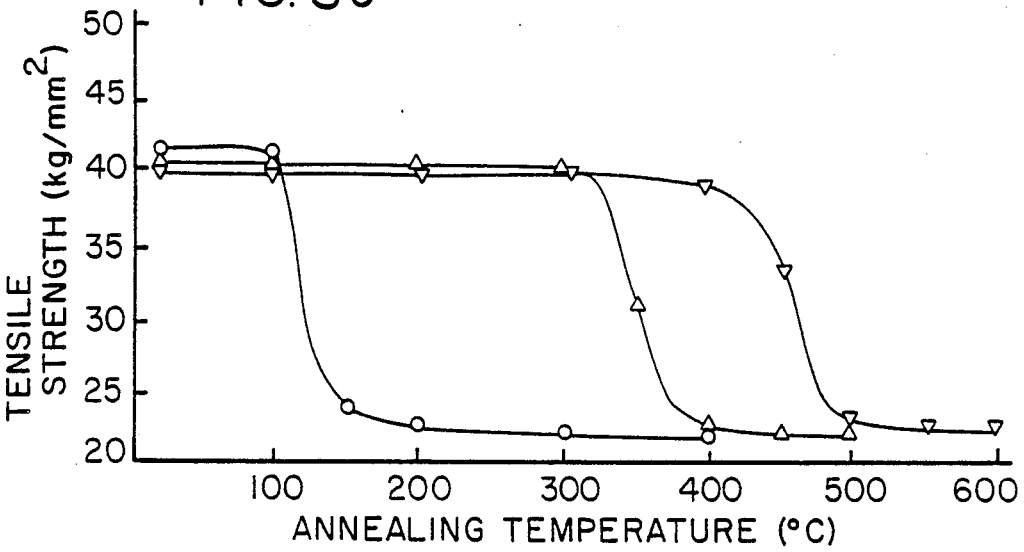

In addition, annealing curves were plotted for similarly produced high-purity copper of 6N-Cu grade and In-, Ag-, and Zr-containing copper alloys (each containing also 0.1 ppm S, 2 ppm O, and a total of less than 3 ppm impurities other than S and O). The results are given in FIGS. 1 to 3, which clearly show that the alloys of the present invention are extremely desirable materials which undergo little changes in mechanical properties through the period during which these materials are worked and used.

Figure 4:
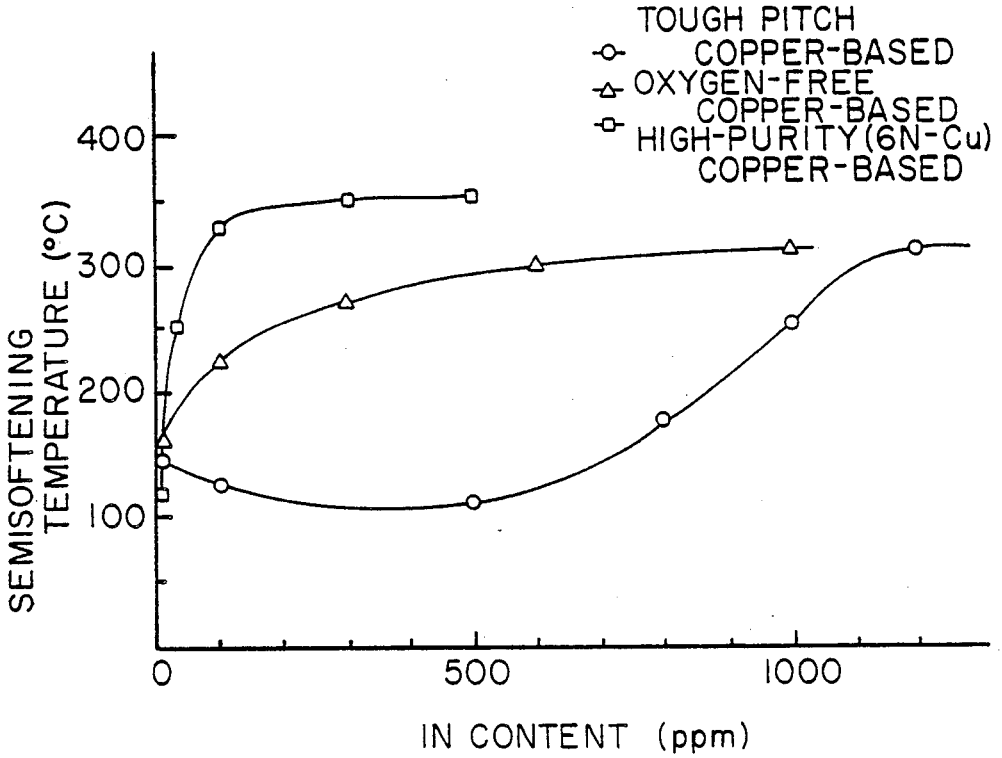
FIG. 4 is a graph showing the relation between the In content and semisoftening temperature of In-containing copper alloys.
Figure 5:
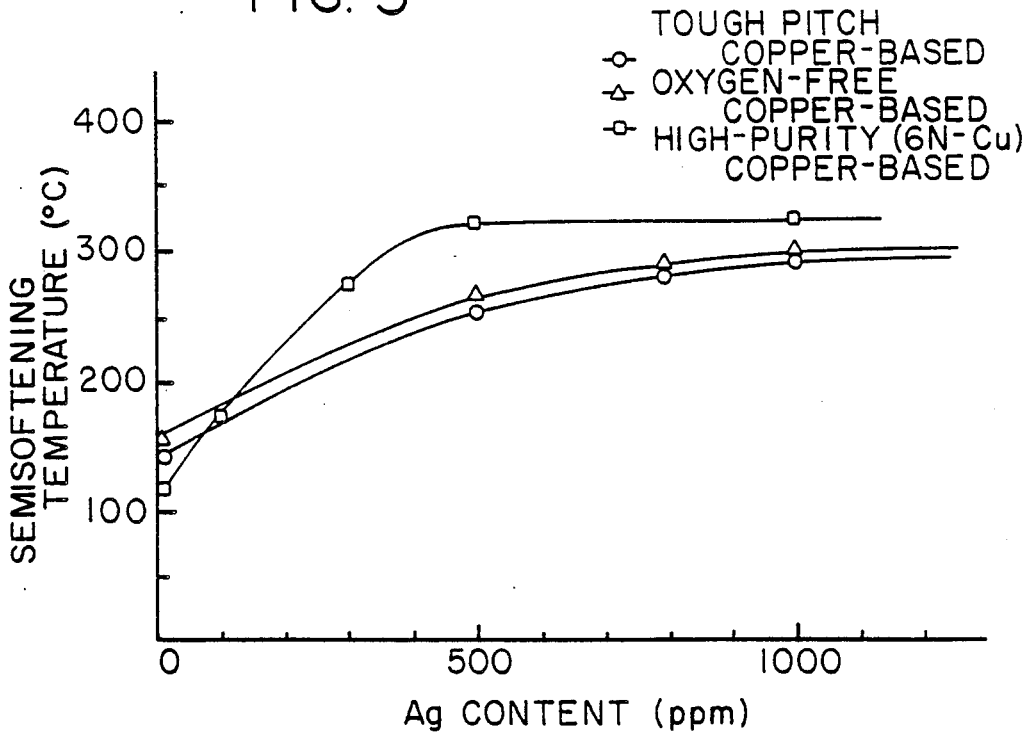
FIG. 5 is a graph showing the relation between the Ag content and semisoftening temperature of Ag-containing copper alloys.
Figure 6:
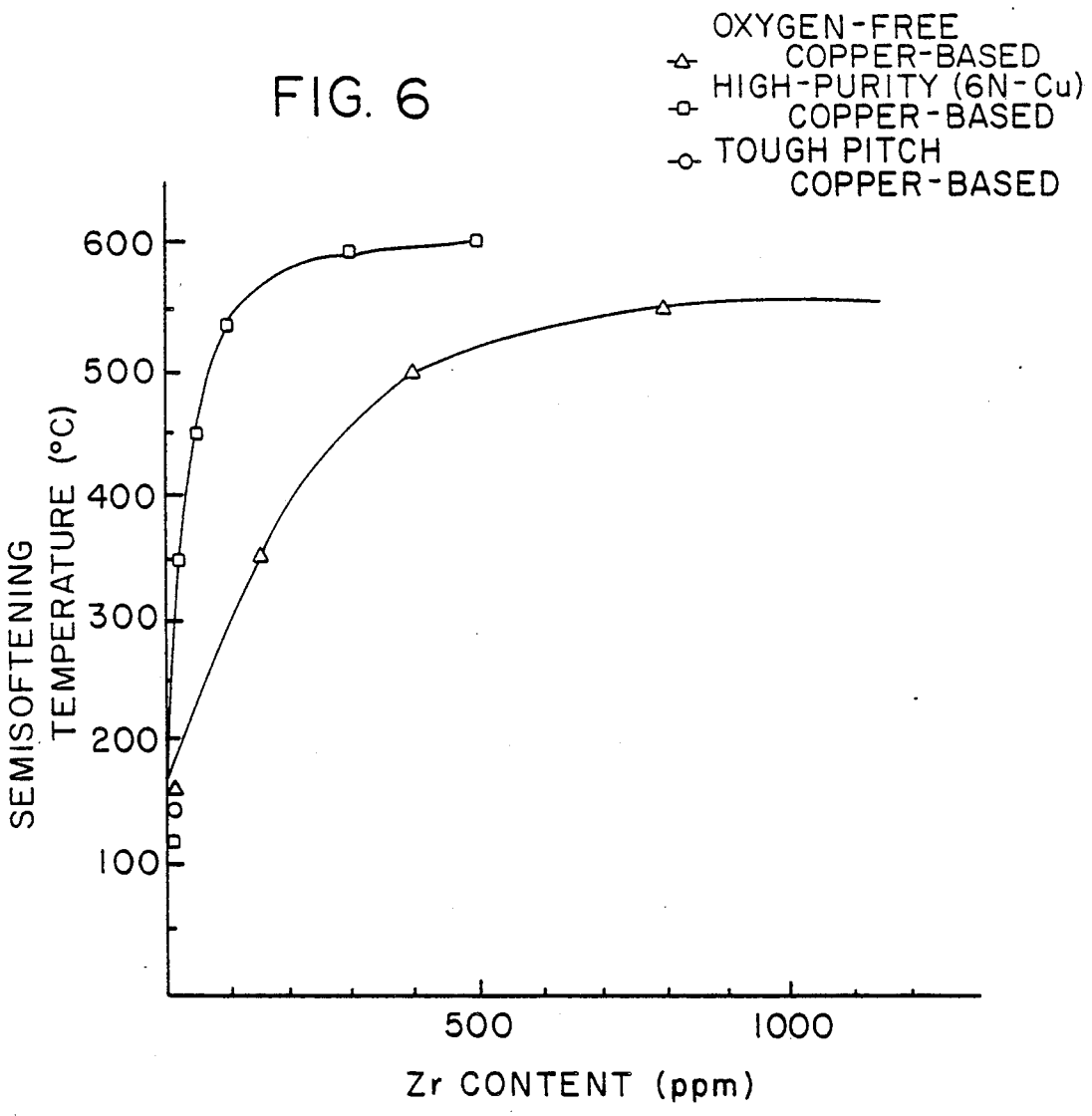
FIG. 6 is a graph showing the relation between the Zr content and semisoftening temperature of Zr-containing copper alloys.

Next, in FIGS. 4 to 6, are compared the results of investigations on the "relation between alloying element content and semi-softening temperature" in In-, Ag-, and Zr-containing copper alloys which were based on three kinds of high-purity copper of 6N-Cu grade (containing 0.1 ppm S, 2 ppm O, and less than 3 ppm impurities other than S and O), tough pitch copper (containing 200–300 ppm O), and oxygen-free copper (containing 10 ppm or less O). FIGS. 4 to 6 also demonstrate the outstanding heat resistance of the alloys according to the present invention.

It will be understandable that a very excellent copper material can be produced by incorpolating an effective alloying element(s) in a specified amount under stricter control of impurities than has been employed before now.

ADVANTAGES OF THE INVENTION

As described above, the present invention provides high-conductivity copper alloys which combine the excellent conductivity of existing materials with good heat resistance, mechanical strength, workability, etc. The invention thus offers advantages of very great industrial significance, contributing, for example, to further improvements in performance of magnet wires, leads for electronic components, printed-circuit boards, and the like.

What we claim is:

1. A high-conductivity copper alloy consisting essentially of 6N copper and at least one element selected from the group consisting of, by weight, 10 to 100 ppm indium,
10 to 1000 ppm silver,
10 to 300 ppm cadmium,
10 to 50 ppm tin,
10 to 50 ppm antimony,
3 to 30 ppm lead,
3 to 30 ppm bismuth,
3 to 30 ppm zirconium,
3 to 50 ppm titanium, and
3 to 30 ppm hafnium, wherein the amount of sulfur as an unavoidable impurity is controlled to less than 3 ppm,
the amount of oxygen as an unavoidable impurity is controlled to less than 5 ppm, and
the total amount of other unavoidable impurities is controlled to less than 3 ppm.

2. A high-conductivity copper alloy consisting essentially of 6N copper and at least one element selected from the group consisting of, by weight, 30 to 80 ppm silver,
100 to 800 ppm silver,
30 to 150 ppm cadmium,
20 to 40 ppm tin,
20 to 40 ppm antimony,
10 to 25 ppm lead,
10 to 25 ppm bismuth,
5 to 20 ppm zirconium,
5 to 30 ppm titanium, and
5 to 20 ppm hafnium, wherein the amount of sulfur as an unavoidable impurity is controlled to less than 3 ppm,
the amount of oxygen as an unavoidable impurity is controlled to less than 5 ppm, and
the total amount of other unavoidable impurities is controlled to less than 3 ppm.

3. A wire formed from copper alloy according to claim 1 or 2.

4. A magnet wire formed from copper alloy according to claim 1 or 2.

5. A lead wire for an electronic component formed from copper alloy according to claim 1 or 2.

6. A lead member for tape automated bonding formed from copper alloy according to claim 1 or 2.

7. A member for a printed-circuit board formed from copper alloy according to claim 1 or 2.

* * * * *